United States Patent [19]

Plessner

[11] 4,224,969

[45] Sep. 30, 1980

[54] UNIVERSAL CHUCK ADAPTOR

[76] Inventor: Jac A. Plessner, 7842 Clearfield Ave., Panorama City, Calif. 91402

[21] Appl. No.: 48,600

[22] Filed: Jun. 14, 1979

[51] Int. Cl.[3] ..... B25B 17/00

[52] U.S. Cl. ..... 145/53; 403/24; 403/287

[58] Field of Search ..... 403/258, 260, 299, 320, 403/287, 343, 24; 145/50 R, 50 B, 51, 53, 54

[56] References Cited

U.S. PATENT DOCUMENTS

| | | | |
|---|---|---|---|
| 942,572 | 12/1909 | Leland et al. | 145/53 |
| 2,874,985 | 2/1959 | March | 403/258 |
| 3,843,143 | 10/1974 | Laxson | 403/299 X |
| 3,869,741 | 3/1975 | Logan | 145/50 A X |
| 3,904,301 | 9/1975 | Schroeder | 403/320 X |

FOREIGN PATENT DOCUMENTS

| | | | |
|---|---|---|---|
| 502348 | 3/1939 | United Kingdom | 145/50 A |

*Primary Examiner*—Andrew V. Kundrat
*Attorney, Agent, or Firm*—W. Edward Johansen

[57] ABSTRACT

The present invention is a universal chuck adaptor which is used in combination with a yankee screwdriver in order to mechanically couple a drill chuck to the yankee screwdriver which includes a handle. The yankee screwdriver also includes a ratchet mechanism which is mechanically coupled to the handle and a release mechanism which is mechanically coupled to the ratchet mechanism. The universal chuck adaptor includes an integral member which has a cylindrical portion at its center, a right-handed, externally threaded cylindrical portion at one end with a left-handed, internally threaded bore and a truncated cylindrical portion with a notch. The truncated cylindrical portion is adapted to be slideably received within the release mechanism and secured thereby. The drill chuck is threadedly coupled to the right-handed, externally threaded cylindrical portion. A left-handed threaded screw securely coupled the drill chuck to the universal chuck adaptor through the left-handed, internally threaded bore.

1 Claim, 3 Drawing Figures

UNIVERSAL CHUCK ADAPTOR

BACKGROUND OF THE INVENTION

1. Field of the Invention

The present invention relates to chuck adapters and hand held mechanically powered screwdrivers, and more particularly to a universal chuck adapter which allows a metal drill bit to be used with a hand held mechanically powered screwdriver.

2. Description of the Prior Art

U.S. Pat. No. 3,843,143, entitled Chuck Adapter, issued to Thomas Earl Laxson on Oct. 22, 1974, teaches an adapter for a chuck having an end face into which opens a threaded socket which enables the chuck to be operated by a manual device such as a wrench. The adapter includes a generally cylindrical body having opposed end faces. Opening onto one of these end faces are a series of threaded bores which decrease in diameter away from the end faces. A threaded stem is screwed into the socket in the chuck and into one of the bores of the adapter. The adapter is formed with two structural arrangements for receiving the effective end of a hand tool for tightening the adapter on the stem. Opening onto the other face of the adapter are a series of non-circular recesses which gradually decrease in diameter away from that face and any one of which is adapted to receive the head of a hand wrench. Extending from each of these sockets to the side surface of the adapter is a radial passage which is adapted to receive the end of a hand tool and the exterior surface of the adapter adjacent this end face is formed with two sets of wrench-engaging surfaces.

U.S. Pat. No. 3,973,784, entitled Cutting Tool Adaptor, issued to Donald Awalt Smith on Aug. 10, 1974, teaches an adaptor for a hand-operated power machine tool such as a power screwdriver. The adaptor includes a sleeve adapted to receive a cutting tool bit in the forward end and an aperture for slidably engaging the shank of the screwdriver bit in the rearward end. The sleeve preferably also comprises a concentric ring mounted grip allowing free relative motion between the grip and the sleeve. The adaptor is used for performing a series of operations where a guide cutting is first made in a workpiece, and then a screw is driven into the guide hole.

U.S. Pat. No. Re. 28,662, entitled Quick-Change Chuck with Adjustable Tool-Holding Socket, reissued to Otto Bilz on Dec. 23, 1975, teaches a quick-change chuck with a hollow cylindrical shank and a tool-holding socket which is inserted into the shank and adapted to be very accurately adjusted by very simple means to different positions in the axial direction relative to the shank.

U.S. Pat. No. 2,730,220, entitled Device for the Attachment of Tools to Drilling and Other Power Operated Metal Working Machines, teaches a device for attaching tools to power operated metal working machines.

U.S. Pat. No. 3,869,741, entitled Combination Treading and Screw Driver Tool, issued to Noel Logan on Mar. 11, 1975, teaches a screw driver which has a threaded portion forming a tap immediately adjacent to the screw engaging end of the screw driver. The screw driver has a flat end on the proximal end and a groove immediately adjacent the proximal end.

Often a carpenter needs to convert his mechanically powered screwdriver to a temporary metal drill in order to drill through sheet metal. It is inconvenient for him to carry an electric hand drill motor. It would be far more convenient for him to be able to adapt his mechanically powered screwdriver to a metal drill by means of a chuck adaptor.

SUMMARY OF THE INVENTION

In view of the foregoing factors and conditions characteristic of the prior art it is a primary object of the present invention to provide a universal chuck adaptor which can mechanically couple a yankee screwdriver to a drill chuck so that it is capable of drilling into cement, wood, steel, tile and bricks.

It is another object of the present invention to provide a universal chuck adaptor which can mechanically couple to a yankee screwdriver so that it can hold phillips and straight screwdrivers and nut drivers for driving sheet metal screws, nuts onto bolts and bolts into tap holes.

In accordance with an embodiment of the present invention a universal chuck adaptor which is used in combination with a yankee screwdriver in order to mechanically couple a drill chuck to the yankee screwdriver which includes a handle is disclosed. The yankee screwdriver also includes a ratchet mechanism which is mechanically coupled to the handle and a release mechanism which is mechanically coupled to the ratchet mechanism. The universal chuck adaptor includes an integral member which has a cylindrical portion at its center, a righthanded, externally threaded cylindrical portion at one end with a left-handed, internally threaded bore and a truncated cylindrical portion with a notch. The truncated cylindrical portion is adapted to be slideably received within the release mechanism and secured thereby. The drill chuck is threadedly coupled to the right-handed, externally threaded cylindrical portion. A left-handed threaded screw securely couples the drill chuck to the universal chuck adaptor through the left-handed, internally threaded bore.

The features of the present invention which are believed to be novel are set forth with particularity in the appended claims.

Other objects and many of the attendant advantages of this invention will be more readily appreciated as the same becomes better understood by reference to the following detailed description and considered in connection with the accompanying drawing in which like reference symbols designate like parts throughout the figures.

DESCRIPTION OF THE PREFERRED EMBODIMENT

Figure 1:
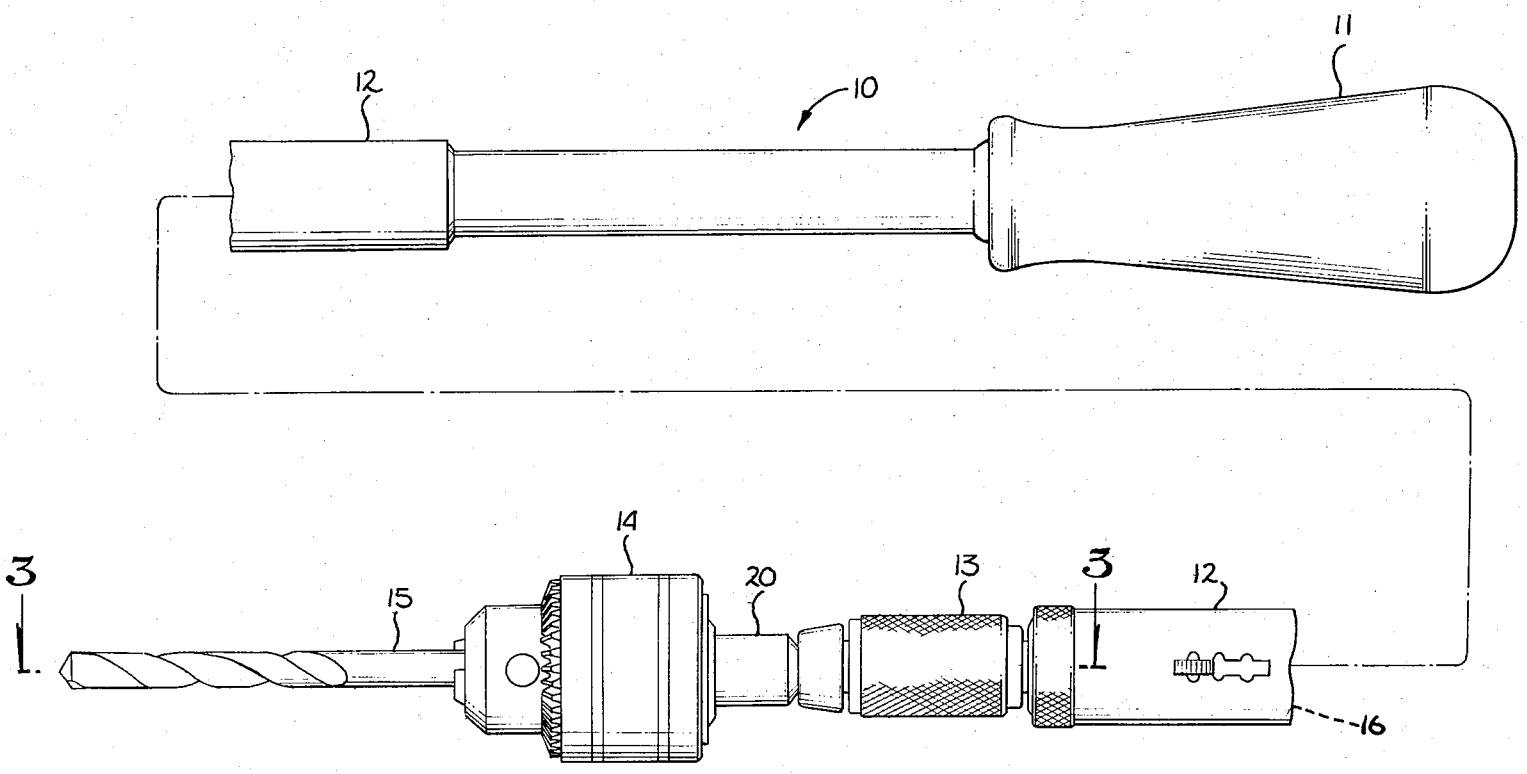
FIG. 1 is a longitudinal view of a yankee screwdriver which is used in combination with a universal chuck adaptor which has been constructed in accordance with the principles of the present invention.

In order to best understand the present invention it is necessary to refer the following description of its preferred embodiment in conjunction with the accompanying drawing. Referring to FIG. 1 a yankee screwdriver 10 includes a handle 11, a ratchet mechanism 12 which is mechanically coupled to the handle 11 and a release mechanism 13 which is mechanically coupled to the ratchet mechanism 12 and which is adapted to receive a rotating tool bit for wood-working. U.S. Pat. No. 942,572, entitled Automatic Tool For Boring, issued to John A. Leland and William G. Stebbins on Dec. 7, 1909, teaches a device which is similar to the Yahnkee screw driver 10.

Still referring to FIG. 1 it is sometimes necessary to mechanically couple a drill chuck 14 to the release mechanism 13 in order to use a metal drill bit 15 in combination with the yankee screwdriver 10 which also has a drive mechanism 16. The present invention is a universal chuck adaptor 20 which is used in combination with the yankee screwdriver 10 to mechanically couple the drill chuck 14 thereto.

Figure 2:
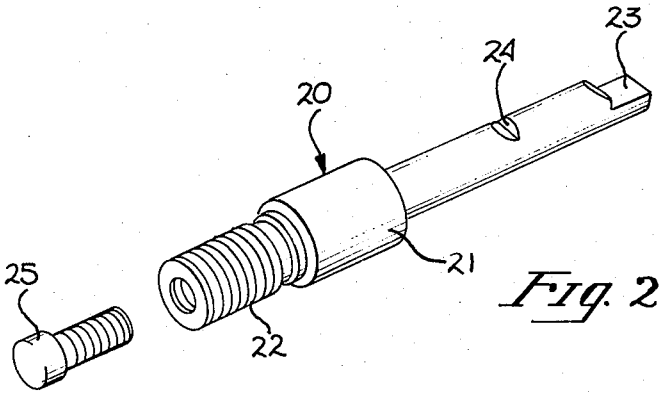
FIG. 2 is a perspective view of the universal chuck adaptor of FIG. 1.

Referring now to FIG. 2 the universal chuck adaptor 20 is an integral member which includes a cylindrical portion 21 in its center-handed, externally threaded portion 22 at one end thereof and a cylindrical portion 23.

Referring again to FIG. 2 the universal chuck adaptor 20 is an integral member which has a first cylindrical portion 21 at its center, a right-handed, externally threaded portion 22 at one end having a left-handed, internally threaded bore and a truncated cylindrical portion 23 with a notch 24.

Figure 3:
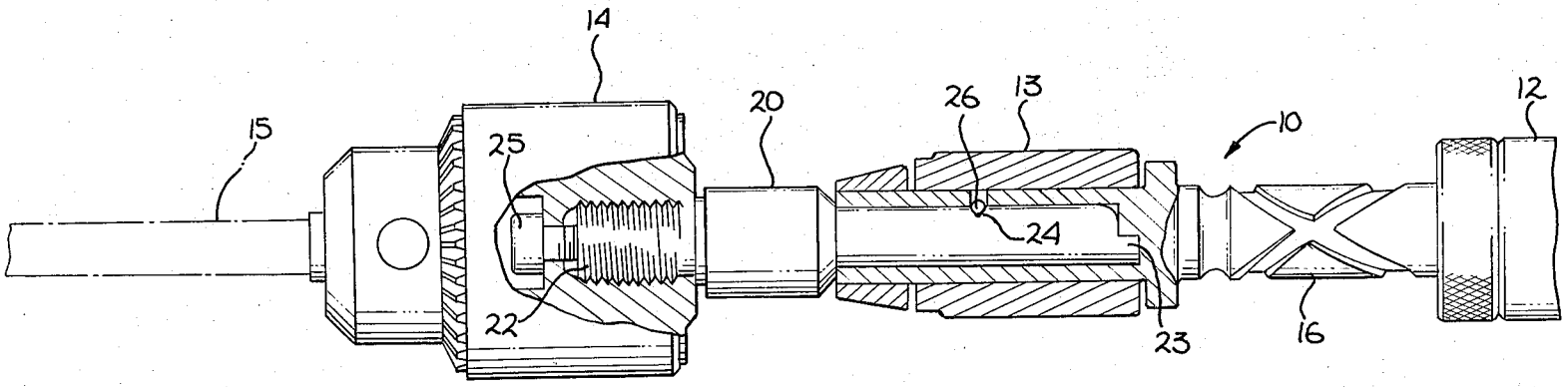
FIG. 3 is a longitudinal cross-sectional view of the yankee screwdriver of FIG. 1 taken along the line 3—3 of FIG. 1 illustrating how the universal chuck adaptor couples both to the drill chuck and to the end of the yankee screwdriver.

Referring to FIG. 3 the right-handed, externally threaded portion 22 receives the drill chuck which is threaded thereon and which is secured thereon by a left-handed screw 25 which is threaded into the left-handed, internally threaded bore. The release mechanism 13 which includes a pin 26 within its bore that secures the universal chuck adaptor 20 therein receives the truncated cylindrical portion 23 slideably therein. The pin 26 secures the universal chuck adaptor 20 therein and a complementary notched portion within the bore of the release mechanism 13 restrains the universal chuck adaptor 20 from rotating within the release mechanism 13.

Among the advantages of the present invention are that the larger drill bits can be used with the yankee screwdriver, that the drill bits may be used which are capable of drilling in cement, wood, steel, tile and bricks and that the yankee screwdriver can also be adapted to hold phillips and straight screwdrivers and nut-drivers for driving sheet metal screws, nuts onto bolts, and bolts into tap holes.

Furthermore, it should be noted that the schematics of the device have not been drawn to scale and that distances of and between the figures are not to be considered significant.

Accordingly, it is intended that the foregoing disclosure and showings made in the drawing shall be considered as illustrations of the principles of the present invention.

What is claimed is:

1. A universal chuck adaptor in combination with a yankee screwdriver in order to mechanically couple a drill chuck to the yankee screwdriver which includes:

a. a handle;

b. a ratchet mechanism which is mechanically coupled to the handle;

c. a release mechanism which is mechanically coupled to the ratchet mechanism, said universal chuck adaptor comprising:

a. an integral member which has a cylindrical portion at its center, a right-handed, externally threaded, cylindrical portion at one end with a left-handed, internally threaded bore and a truncated cylindrical portion with a notch at the other end, whereby said truncated cylindrical portion is slideably received within the release mechanism and secured thereby and whereby the drill chuck is threadedly coupled to said right-handed, externally threaded cylindrical portion; and b. a left-handed threaded screw securely couples the drill chuck to said universal chuck adaptor through the left-handed, internally threaded bore.

* * * * *